US009238289B2

(12) United States Patent
Aoki et al.

(10) Patent No.: US 9,238,289 B2
(45) Date of Patent: Jan. 19, 2016

(54) GRINDING METHOD OF GRINDING ROLLER WORKPIECE AND GRINDING APPARATUS FOR GRINDING ROLLER WORKPIECE

(71) Applicant: JTEKT CORPORATION, Osaka-shi, Osaka (JP)

(72) Inventors: Yuta Aoki, Kashiba (JP); Kazushi Mizutani, Kashiba (JP)

(73) Assignee: JTEKT CORPORATION, Osaka-shi (JP)

( * ) Notice: Subject to any disclaimer, the term of this patent is extended or adjusted under 35 U.S.C. 154(b) by 0 days.

(21) Appl. No.: 14/508,571

(22) Filed: Oct. 7, 2014

(65) Prior Publication Data

US 2015/0111474 A1 Apr. 23, 2015

(30) Foreign Application Priority Data

Oct. 17, 2013 (JP) ..... 2013-216530

(51) Int. Cl.
*B24B 5/37* (2006.01)
*B24B 5/14* (2006.01)

(52) U.S. Cl.
CPC .... *B24B 5/37* (2013.01); *B24B 5/14* (2013.01)

(58) Field of Classification Search
CPC ..... B24B 5/37; B24B 5/14; B24B 5/04; B24B 1/00; B24B 5/18; B24B 5/42; B24B 5/38
USPC ..... 451/49, 11, 231, 254
See application file for complete search history.

(56) References Cited

U.S. PATENT DOCUMENTS

| | | | | |
|---|---|---|---|---|
| 3,334,445 | A * | 8/1967 | Green | B24B 5/14 451/243 |
| 5,766,057 | A * | 6/1998 | Maack | B24B 5/35 451/194 |
| 6,200,200 | B1 * | 3/2001 | Himmelsbach | B24B 19/12 451/195 |
| 7,972,195 | B2 * | 7/2011 | Ogawa | B24B 5/366 451/49 |
| 7,997,954 | B2 * | 8/2011 | Kobayashi | B24B 5/18 451/11 |
| 8,100,738 | B2 * | 1/2012 | Tschudin | B24B 5/02 451/10 |
| 2002/0115391 | A1 * | 8/2002 | Yamaguchi | B24B 5/24 451/49 |
| 2003/0236058 | A1 * | 12/2003 | Kamamura | B24B 5/01 451/49 |
| 2004/0142643 | A1 * | 7/2004 | Miller | A61M 25/09 451/48 |
| 2005/0026553 | A1 * | 2/2005 | Bonner | B24B 5/18 451/49 |
| 2012/0009852 | A1 * | 1/2012 | Sugitatsu | B24B 7/17 451/177 |

FOREIGN PATENT DOCUMENTS

| | | |
|---|---|---|
| JP | A-2001-225247 | 8/2001 |
| JP | A-2009-274192 | 11/2009 |

* cited by examiner

*Primary Examiner* — George Nguyen
(74) *Attorney, Agent, or Firm* — Oliff PLC

(57) ABSTRACT

A grinding method of grinding a roller workpiece to be formed into a roller of a rolling bearing includes an outer peripheral face machining step. In the outer peripheral face machining step, an outer peripheral face of a regulating wheel that is rotating, is brought into contact with an outer peripheral face of the roller workpiece that is supported from below by a support member, to rotate the roller workpiece, and a grinding wheel is brought into contact with the outer peripheral face of the roller workpiece that is rotating to grind the outer peripheral face of the roller workpiece. In the outer peripheral face machining step, the outer peripheral face of the roller workpiece is ground with a reference member held in point contact with a center of an end face of the roller workpiece.

10 Claims, 8 Drawing Sheets

GRINDING METHOD OF GRINDING ROLLER WORKPIECE AND GRINDING APPARATUS FOR GRINDING ROLLER WORKPIECE

INCORPORATION BY REFERENCE

The disclosure of Japanese Patent Application No. 2013-216530 filed on Oct. 17, 2013 including the specification, drawings and abstract, is incorporated herein by reference in its entirety.

BACKGROUND OF THE INVENTION

1. Field of the Invention

The invention relates to a grinding method of grinding a roller workpiece to be formed into a roller of a rolling bearing, and a grinding apparatus that grinds the roller workpiece.

2. Description of the Related Art

Rollers of a rolling bearing roll on the raceway surface of an inner ring and the raceway surface of an outer ring. Thus, the outer peripheral face of each roller is subjected to finish grinding. Further, the axial end face of each roller, which comes into sliding contact, for example, with a rib of the inner ring, is also subjected to finish grinding. Conventional methods of grinding the outer peripheral face of a roller include infeed centerless grinding in addition to through-feed centerless grinding described in Japanese Patent Application Publication No. 2009-274192 (JP 2009-274192 A).

The infeed centerless grinding is performed as follows: a roller workpiece to be ground is supported from below by a blade (support member); the outer peripheral face of a regulating wheel is brought into contact with the outer peripheral face of the roller workpiece; the regulating wheel is rotated, which causes the roller workpiece to rotate about its central axis; and a grinding wheel is brought into contact with the outer peripheral face of the roller workpiece that is rotating, to grind the outer peripheral face of the roller workpiece. While the outer peripheral surface the roller workpiece is being ground, a reference member is held in surface contact with the axial end face of the roller workpiece. That is, the outer peripheral face of the roller workpiece is ground using the end face of the roller workpiece as the reference surface.

However, because the roller workpiece is formed through forging and heat treatment performed after the forging, the accuracy of its axial end face is low. Thus, when the roller workpiece is rotated with the reference member held in surface contact with the axial end face of the roller workpiece, the roller workpiece may move (although slightly) back and forth in the axial direction due to the runout of the end face. Grinding the outer peripheral face of the roller workpiece in such a state would result in a low finish accuracy of the outer peripheral face. Then, grinding the axial end face of the roller workpiece using the outer peripheral face of the roller workpiece as the reference surface would result in a low finish accuracy of the end face.

Therefore, grinding of a roller workpiece is performed as follows. First, as illustrated in FIG. 9A, an outer peripheral face 92 of a roller workpiece 90 is ground with a first reference member 95 held in surface contact with an axial end face 91 of the roller workpiece 90. In this case, due to the above-described behavior of the roller workpiece 90, that is, the roller workpiece 90's moving back and forth in the axial direction, the finish accuracy of the outer peripheral face 92 becomes low. In FIG. 9A to FIG. 9E, the surface to be ground is indicated by a triangle. When grinding of the outer peripheral face 92 is completed, as illustrated in FIG. 9B, a second reference member 96 is brought into surface contact with the outer peripheral face 92, and the roller workpiece 90 is rotated and the end face 91 is ground using the outer peripheral face 92 as the reference surface. Because the finish accuracy of the outer peripheral face 92 used as the reference surface is low as described above, the finish accuracy of the ground end face 91 of the roller workpiece 90 also becomes low. Therefore, as illustrated in FIG. 9C, the roller workpiece 90 is rotated and the outer peripheral face 92 is ground again with the first reference member 95 held in surface contact with the end face 91 of the roller workpiece 90. Then, as illustrated in FIG. 9D, the roller workpiece 90 is rotated and the end face 91 is ground again using the outer peripheral face 92 as the reference surface. If the accuracy of the outer peripheral face 92 still fails to reach the design value, as illustrated in FIG. 9E, the outer peripheral face 92 of the roller workpiece 90 is ground using the end face 91 as the reference surface.

In this way, a prescribed dimensional accuracy is secured by repeatedly performing the step of grinding the outer peripheral face 92 using the end face 91 of the roller workpiece 90 as the reference surface, and the step of grinding the end face 91 using the outer peripheral face 92 of the roller workpiece 90 as the reference surface.

In the conventional grinding method described above, increasing the dimensional accuracy of the outer peripheral face of the roller requires repetition of grinding of the outer peripheral face 92 and grinding of the end face 91. However, if these grinding steps are repeatedly performed, the number of man-hours increases and works such as interchanging the reference members 95, 96 and rearranging the roller workpiece 90 to be ground are involved in each step, leading to low productivity.

SUMMARY OF THE INVENTION

One object of the invention is to provide a grinding method and a grinding apparatus that make it possible to increase the dimensional accuracy of an outer peripheral face of a roller workpiece without the need for repeatedly grinding the outer peripheral face and grinding an end face of the roller workpiece.

An aspect of the invention relates to a grinding method of grinding a roller workpiece to be formed into a roller of a rolling bearing, the grinding method including an outer peripheral face machining step. In the outer peripheral face machining step, an outer peripheral face of a regulating wheel that is rotating, is brought into contact with an outer peripheral face of the roller workpiece that is supported from below by a support member, to rotate the roller workpiece, and a grinding wheel is brought into contact with the outer peripheral face of the roller workpiece that is rotating to grind the outer peripheral face of the roller workpiece. In the outer peripheral face machining step, the outer peripheral face of the roller workpiece is ground with a reference member held in point contact with a center of an end face of the roller workpiece.

BRIEF DESCRIPTION OF THE DRAWINGS

The foregoing and further features and advantages of the invention will become apparent from the following description of example embodiments with reference to the accompanying drawings, wherein like numerals are used to represent like elements and wherein.

DETAILED DESCRIPTION OF EMBODIMENTS

Figure 1:
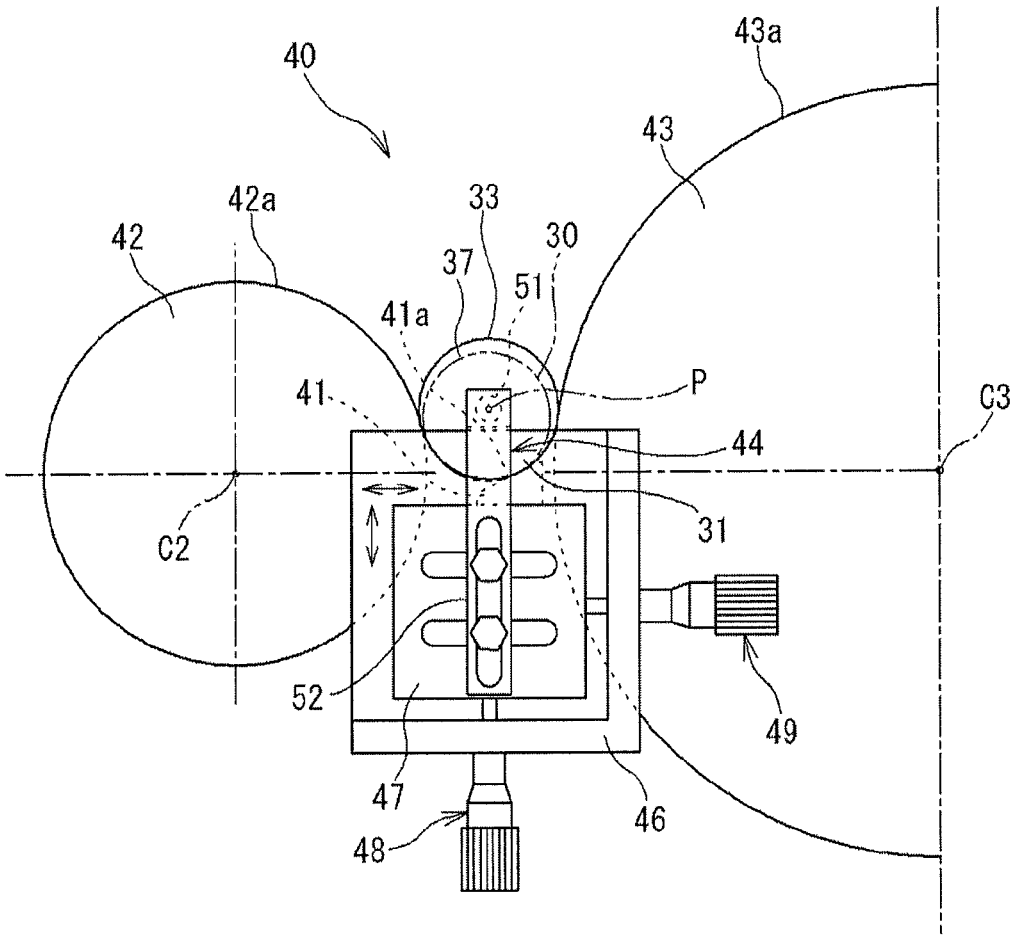
FIG. 1 is a side view illustrating the schematic configuration of a grinding apparatus.
Figure 2:
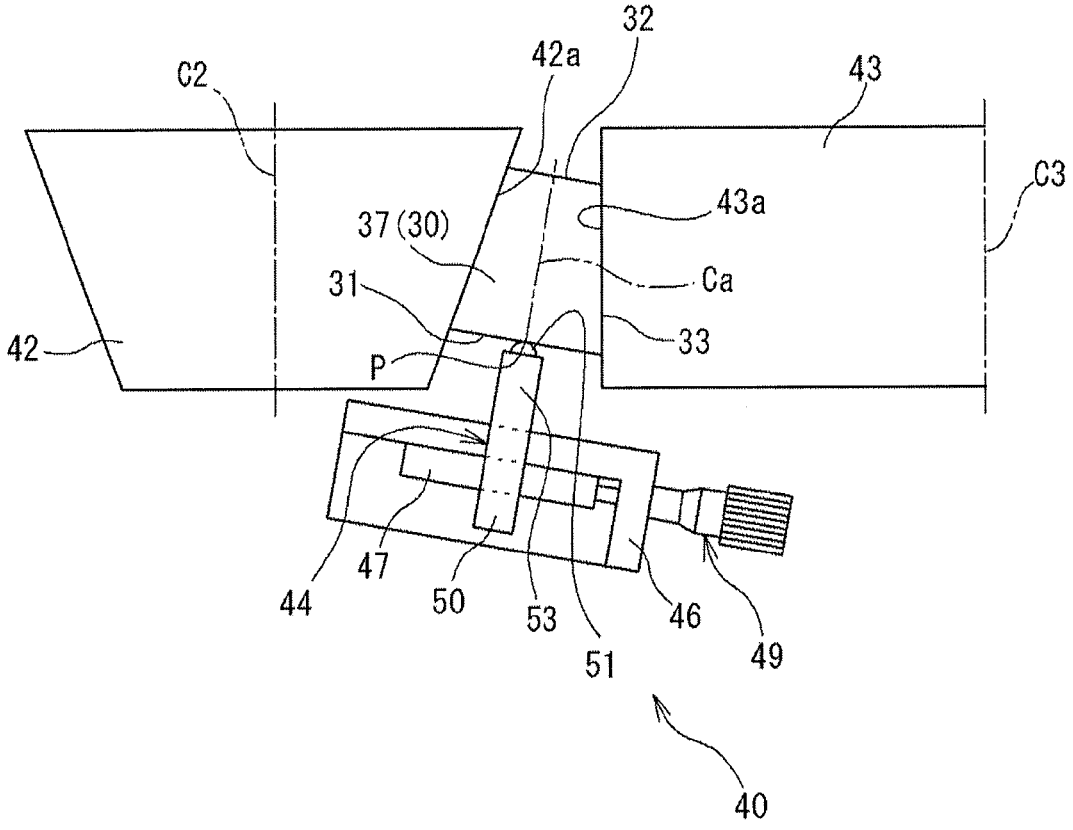
FIG. 2 is a plan view illustrating the schematic configuration of the grinding apparatus.
Figure 3:
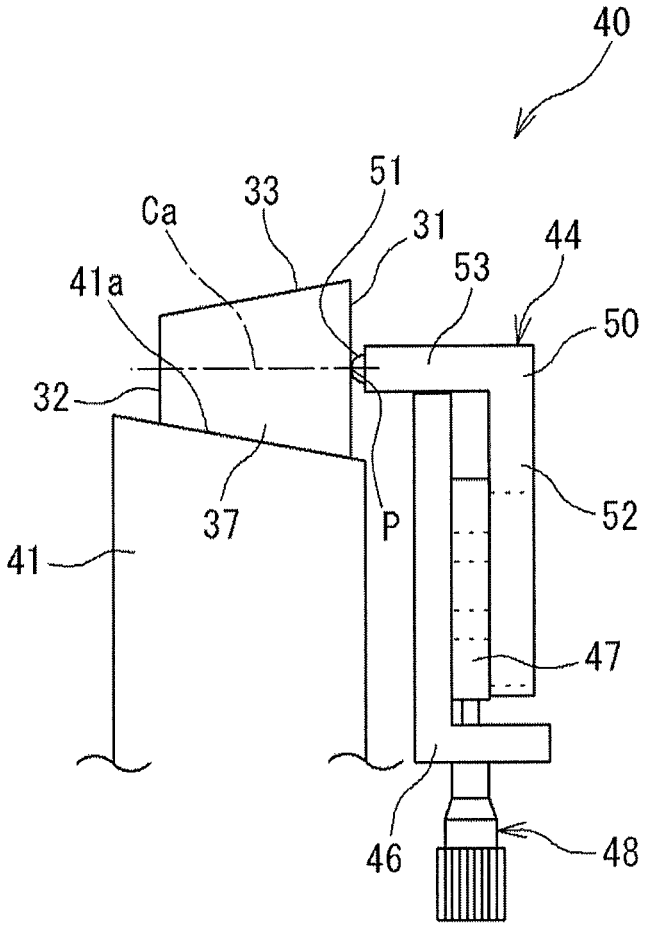
FIG. 3 is a front view illustrating the schematic configuration of the grinding apparatus.
Figure 4:
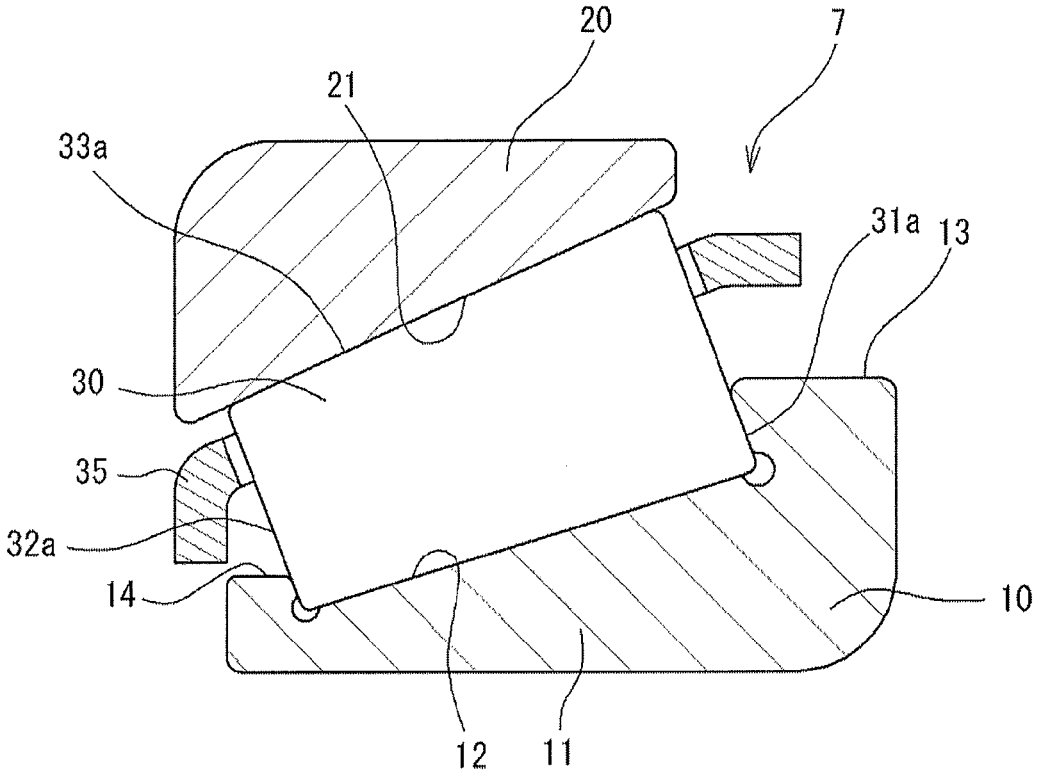
FIG. 4 is a longitudinal sectional view of a rolling bearing including rollers each having the outer peripheral face that has been ground by the grinding apparatus.

Hereinafter, example embodiments of the invention will be described with reference to the accompanying drawings. FIG. 1 to FIG. 3 are views each illustrating the schematic configuration of a grinding apparatus 40 that grinds a roller workpiece to be formed into a roller 30 of a rolling bearing 7. FIG. 1 is a side view of the grinding apparatus 40. FIG. 2 is a plan view of the grinding apparatus 40. FIG. 3 is a front view of the grinding apparatus 40. FIG. 4 is a longitudinal sectional view of the rolling bearing 7 including the rollers 30 each having the outer peripheral face that has been ground by the grinding apparatus 40. First, the schematic configuration of the rolling bearing 7 will be described.

As illustrated in FIG. 4, the rolling bearing 7 includes an inner ring 10, an outer ring 20, the rollers 30, and an annular cage 35. The rollers 30 are interposed between the inner ring 10 and the outer ring 20. The cage 35 retains the rollers 30. The rollers 30 in the present embodiment are tapered rollers, and the rolling bearing 7 is a tapered roller bearing.

The outer ring 20 is a cylindrical member that is fitted on the inner peripheral face of a housing (not illustrated). The inner peripheral face of the outer ring 20 is a tapered face of which the inner diameter increases toward one side in the axial direction (the right side in FIG. 4). The tapered face (partially) serves as a raceway surface 21 on which the rollers 30 roll (revolve while rotating).

The inner ring 10 is a cylindrical member that is fitted onto a shaft (not illustrated). The inner ring 10 and the outer ring 20 are arranged concentrically. In the present embodiment, the inner ring 10 has a cylindrical bearing ring main portion 11 and annular rib portions 13, 14. The bearing ring main portion 11 has a raceway surface 12, on which the multiple rollers 30 roll (revolve while rotating), on its outer periphery. The rib portions 13, 14 protrude radially outward from the axial ends of the bearing ring main portion 11. The outer peripheral face of the bearing ring main portion 11 has a tapered face of which the outer diameter increases toward the one side in the axial direction (the right side in FIG. 4). The tapered face has the raceway surface 12.

Each roller 30 has a truncated conical shape. Each roller 30 has an axial end face 31*a* having a large diameter and an axial end face 32*a* having a diameter smaller than that of the axial end face 31*a*. The cage 35 retains the multiple rollers 30 at prescribed intervals (regular intervals) along the peripheral direction such that each roller 30 is rollable.

When an axial load is applied to the rolling bearing 7, the rib portion 13 on the larger diameter side and the axial end face 31*a* of each roller 30 are brought into contact with each other and the rib portion 13 receives a load from each roller 30 based on the axial load. At the same time, each of the rollers 30 receives a load from the rib portion 13 as a reaction force. These loads each have an axial load component. The axial load component is larger than the radial load component. Thus, each roller 30 rolls on the raceway surfaces 21, 12 with the larger diameter-side end face 31*a* held in sliding contact with the rib portion 13.

The inner ring 10, the outer ring 20, and the rollers 30 are made of, for example, bearing steel (SUJ2). The cage 35 is made of, for example, resin. The grinding apparatus 40 illustrated in FIG. 1 grinds an outer peripheral face 33 and an end face 31 of a workpiece, thereby producing the roller 30. The workpiece to be ground (hereinafter, referred to as "roller workpiece") is formed through forging and heat treatment performed after the forging. Because the roller 30 has a truncated conical shape, the roller workpiece also has a truncated conical shape. The surfaces of the roller workpiece are surfaces as forged, and thus the dimensional accuracy of the surfaces is low.

As illustrated in FIG. 1 to FIG. 3, the grinding apparatus 40 includes a blade (support member) 41, a regulating wheel 42, a grinding wheel 43, and a reference member 44. The blade 41 supports the roller workpiece 37 from below. The grinding wheel 43 grinds the outer peripheral face 33 of the roller workpiece 37. The grinding apparatus 40 further includes actuators 48, 49. The actuators 48, 49 move the reference member 44 while the outer peripheral face 33 of the roller workpiece 37 is being ground by the grinding wheel 43.

The blade 41 is a base member and is elongated in the vertical direction. The roller workpiece 37 is placed on an upper face 41*a* of the blade 41. As illustrated in FIG. 1, the upper face 41*a* is a tilted face that is tilted downward in a direction toward the regulating wheel 42. The tilted face allows the roller workpiece 37 to be kept in contact with the regulating wheel 42 and the grinding wheel 43 even when the dimension of the roller workpiece 37 changes due to machining.

The regulating wheel 42 is a truncated conical wheel (see FIG. 2), and rotates about a central axis C2 of the regulating wheel 42 by the drive the power generated by a drive unit including, for example, a motor (not illustrated). An outer peripheral face 42*a* of the regulating wheel 42 has a tilted face that conforms to the outer peripheral face 33 of the roller workpiece 37, and the regulating wheel 42 and the roller workpiece 37 come into line contact with each other. Thus, the regulating wheel 42 rotates while being in contact with the outer peripheral face 33 of the roller workpiece 37, thereby rotating the roller workpiece 37 about a central axis Ca of the roller workpiece 37.

The grinding wheel 43 has a short columnar shape, and rotates around a central axis C3 of the grinding wheel 43 by the drive power generated by a drive unit including, for example, a motor. As illustrated in FIG. 1, the grinding wheel 43 and the regulating wheel 42 are disposed at a distance in the horizontal direction. A space for the roller workpiece 37 is left between the grinding wheel 43 and the regulating wheel 42. At least one of the grinding wheel 43 and the regulating wheel 42 is movable in the horizontal direction. Thus, the distance between the grinding wheel 43 and the regulating wheel 42 is adjustable. As an outer peripheral face 43*a* of the grinding wheel 43 is brought into contact with the outer peripheral face 33 of the roller workpiece 37, the grinding wheel 43 is able to grind (to perform centerless grinding on) the outer peripheral face 33 of the roller workpiece 37 that is rotating. As illustrated in FIG. 2, in a plan view, the distance between the outer peripheral face 42*a* of the regulating wheel 42 and the outer peripheral face 43*a* of the grinding wheel 43 is reduced in a direction toward one side (the upper side in FIG. 2) in the axial direction of the roller workpiece 37. Thus, the roller workpiece 37 is ground while its movement in the direction toward the one side (the upper side in FIG. 2) in the axial direction is restricted.

The reference member 44 (see FIG. 3) has a main portion 50 and a contact 51. The contact 51 is brought into contact with the larger diameter-side end face 31 of the roller workpiece 37. The main portion 50 has a base portion 52 and a distal end portion 53. The base portion 52 extends in the up-down direction. The distal end portion 53 extends in the transverse direction (the horizontal direction) from an upper portion of the base portion 52. The contact 51 is provided at the end of the distal end portion 53.

The end face 31 of the roller workpiece 37 is circular. The reference member 44 is positioned such that the contact 51 comes into point contact with a center P of the end face 31. The center P is an intersection between the end face 31 and the central axis Ca. As the roller workpiece 37 rotates during grinding, the contact 51 and the end face 31 of the roller workpiece 37 come into sliding contact with each other. Therefore, in the reference member 44, at least the contact 51 is preferably made of ceramics or cemented carbide, which have sufficient resistance to abrasion, because the contact 51 comes into sliding contact with the end face 31 of the roller workpiece 37. In the present embodiment, the contact 51 has a spherical shape (semispherical shape). Thus, the contact 51 reliably comes into point contact with the center P of the end face 31, which makes it possible to reduce the resistance when the contact 51 and the end face 31 come into sliding contact with each other.

The reference member 44 is disposed so as to be immovable in the axial direction of the roller workpiece 37. The contact 51 comes into point contact with the end face 31 of the roller workpiece 37 so as to push the end face 31 toward one side in the axial direction (the side on which the small diameter-side end face 32 of the roller workpiece 37 is located). As described above, during grinding, the movement of the roller workpiece 37, which is held between the regulating wheel 42 and the grinding wheel 43, toward the one side in the axial direction is restricted, but the roller workpiece 37 is movable in a direction toward the other side in the axial direction. Hence, the contact 51 is brought into contact with the center P of the end face 31 of the roller workpiece 37 to support the roller workpiece 37 in the axial direction, so that the movement of the roller workpiece 37 in the direction toward the other side in the axial direction is restricted by the contact 51. As described above, the contact 51 of the reference member 44 is brought into point contact with the center P of the end face 31 of the roller workpiece 37. In this way, the axial movement (movement toward the other side in the axial direction) of the roller workpiece 37 is restricted, and in this state, the grinding wheel 43 grinds the roller workpiece 37 using the center P as the reference. The machining allowance of the outer peripheral face 33 (the amount by which the outer peripheral face 33 is ground) in the grinding process is, for example, 0.1 to 0.2 mm (in diameter), although the machining allowance varies depending on the diameter of the roller workpiece 37.

As illustrated in FIG. 1, the reference member 44 is fitted to a fixing frame 46 which is in a fixed state. In the present embodiment, the reference member 44 is fitted to the fixing frame 46 via a movable frame 47. The movable frame 47 is fitted to the fixing frame 46 such that the movable frame 47 is movable, relative to the fixing frame 46, two-dimensionally along a plane perpendicular to the central axis Ca of the roller workpiece 37. The reference member 44 is fitted to the movable frame 47. The fixing frame 46 is provided with the actuators 48, 49. The first actuator 48 allows the movable frame 47 to move in the up-down direction relative to the fixing frame 46, while the second actuator 49 allows the movable frame 47 to move in the transverse direction (the direction perpendicular to the up-down direction; in the present embodiment, the horizontal direction) relative to the fixing frame 46.

Each of the actuators 48, 49 is a device that moves the movable frame 47 linearly. The movable frame 47 is moved as a worker manually operates the actuators 48, 49. Alternatively, the movable frame 47 is moved as a computer (not illustrated) executes numerical control on the actuators 48, 49. By moving the movable frame 47 with the actuators 48, 49, the position of the reference member 44 is adjusted to bring the contact 51 into point contact with the center P of the end face 31 of the roller workpiece 37. This positional adjustment may be made by adjusting the mounting position of the reference member 44 relative to the movable frame 47. Each of the actuators 48, 49 is configured, for example, such that it extends or contracts as a screw inner shaft rotates in the normal direction or in the reverse direction. Therefore, by executing numerical control on the rotation of the screw shaft, the reference member 44 is moved by an amount corresponding to a prescribed value in a prescribed direction. The function of moving the reference member 44 by executing numerical control on the actuators 48, 49 will be described later.

When a reference member is brought into surface contact with the end face of a roller workpiece as in the related art, if the dimensional accuracy of the end face is low, the roller workpiece moves back and force in the axial direction due to the runout of the end face during rotation of the roller workpiece. This results in low dimensional accuracy of the outer peripheral face formed by grinding. However, according to the present embodiment, the contact 51 of the reference member 44 is brought into one-point contact with the center P of the end face 31 of the roller workpiece 37. Thus, the roller workpiece 37 is restrained from moving back and force in the axial direction due to the runout of the end face 31, and the outer peripheral face 33 of the roller workpiece 37 is ground by the grinding wheel 43 using the center P as the reference.

As described above, in centerless grinding of the outer peripheral face 33 of the roller workpiece 37, a single point, that is, the center of the end face 31, serves as the reference point for positioning the roller workpiece 37 in the axial direction. Therefore, even when the dimensional accuracy of the end face 31 of the roller workpiece 37 to be ground is low, the roller workpiece 37 is restrained from moving back and forth in the axial direction. In this way, the finish accuracy of the outer peripheral face 33 is increased. As a result, it is possible to increase the dimensional accuracy of the outer peripheral face 33 of the roller workpiece 37 without the need for repeatedly grinding the outer peripheral face and grinding the end face as in the related art.

Figure 5:
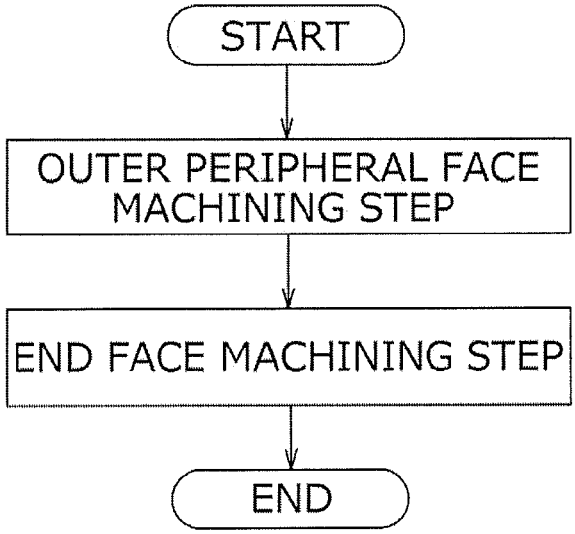
FIG. 5 is a flowchart of a grinding method of grinding a roller workpiece with the grinding apparatus.

A first grinding method of grinding the roller workpiece 37 with the grinding apparatus 40 will be described below. FIG. 5 is a flowchart of the grinding method. The grinding method of grinding the roller workpiece 37 includes an outer peripheral face machining step and an end face machining step. In the outer peripheral face machining step, the outer peripheral face 33 of the roller workpiece 37 is ground. In the end face machining step, the end face 31 of the roller workpiece 37 is ground.

The outer peripheral face machining step will now be described. As illustrated in FIG. 3, the roller workpiece 37 to be ground is placed on the blade 41, and the reference member 44 is brought into point contact with the end face 31 of the roller workpiece 37 disposed on the blade 41. Alternatively, the reference member 44 may be disposed at a prescribed position in advance, and then the roller workpiece 37 to be ground may be placed on the blade 41 such that the end face 31 of the roller workpiece 37 is brought into point contact with the reference member 44. Then, the regulating wheel 42 and the grinding wheel 43 are brought closer to the roller workpiece 37, so that, as illustrated in FIG. 1 and FIG. 2, the roller workpiece 37 is held between the regulating wheel 42 and the grinding wheel 43. The positional adjustment of the contact 51 relative to the end face of the roller workpiece 37 may be made by the actuators 48, 49. As the regulating wheel 42 is driven and the outer peripheral face 33 of the roller workpiece 37 is brought into contact with the outer peripheral face 42*a* of the regulating wheel 42, the roller workpiece 37 rotates about the central axis Ca. As the grinding wheel 43 is rotated to rotate in accordance with the rotation of the regulating wheel 42, the centerless grinding (infeed centerless grinding) on the outer peripheral face 33 of the roller workpiece 37 is performed.

As described above, in the outer peripheral face machining step, the outer peripheral face 42*a* of the regulating wheel 42 that is rotating, is brought into contact with the outer peripheral face 33 of the roller workpiece 37, which is supported from below by the blade 41, to rotate the roller workpiece 37, and the grinding wheel 43 is brought into contact with the outer peripheral face 33 of the roller workpiece 37 that is rotating, to grind the outer peripheral face 33 of the roller workpiece 37. In addition, in the outer peripheral face machining step, the outer peripheral face 33 of the roller workpiece 37 is ground with the contact 51 of the reference member 44 held in point contact with the center P of the end face 31 of the roller workpiece 37.

Figure 6:
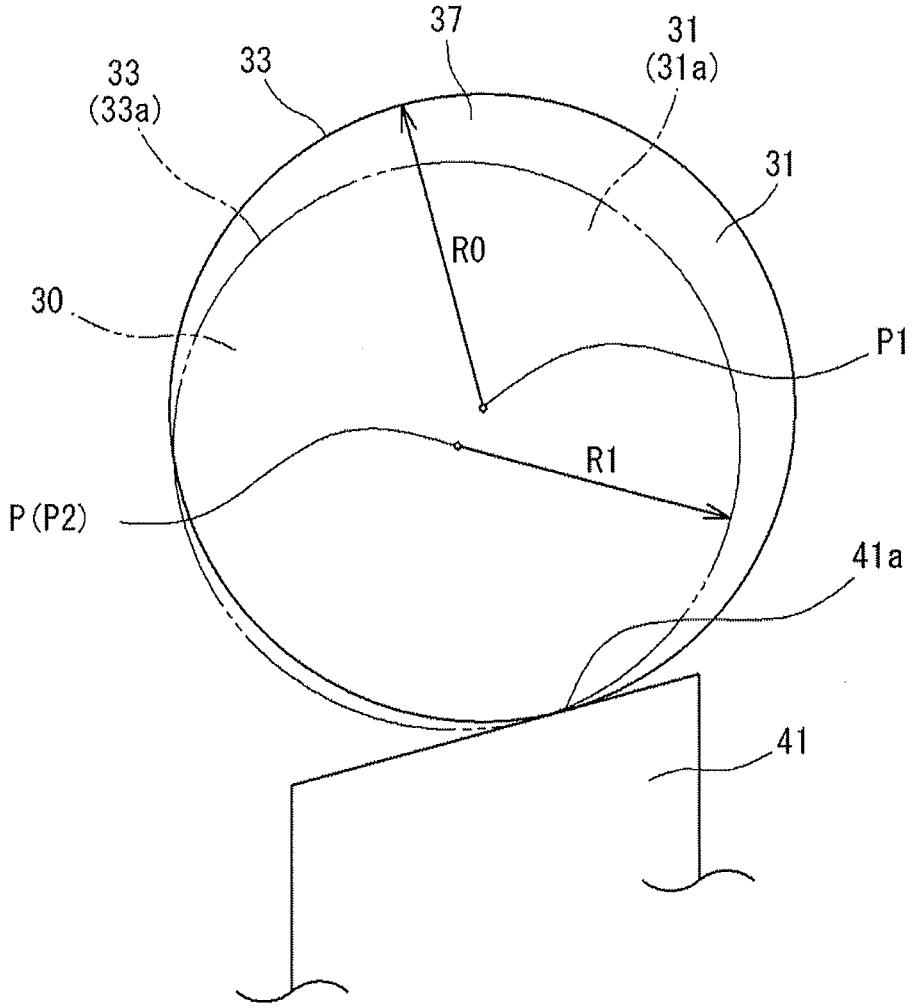
FIG. 6 is a view for explaining a first grinding method of grinding a roller workpiece.

As described above, in the outer peripheral face machining step, the contact 51 of the reference member 44 is brought into point contact with the center P of the end face 31 of the roller workpiece 37 disposed on the blade 41. As illustrated in FIG. 6, the center P at which the contact 51 is brought into point contact with the end face 31 is a designed center point P2 of the end face 31 of the roller workpiece 37 that is supposed to be obtained when grinding of the outer peripheral face 33 on the basis of the designed dimensions is completed. In FIG. 6, the continuous line indicates the contour shape of the end face 31 at the start of grinding, and the long dashed double-short dashed line indicates the contour shape of the end face 31 obtained upon completion of grinding of the outer peripheral face 33. That is, the long dashed double-short dashed line indicates the contour shape of the end face 31 of the roller workpiece 37 that has been ground to have the designed dimensions. In FIG. 6, the center point P1 is the center point of the end face 31 of the roller workpiece 37 at the start of grinding. Not only in FIG. 6 but also in FIG. 7 and FIG. 8 (described later), the change in the size of the end face 31 of the roller workpiece 37 due to grinding is emphasized for easy understanding.

According to the grinding method, as the grinding of the outer peripheral face 33 of the roller workpiece 37 proceeds, the diameter of the end face 31 of the roller workpiece 37 becomes gradually smaller. That is, a radius R0 of the end face 31 at the start of grinding and a radius R1 of the end face 31 upon completion of grinding are different from each other (R0>R1). In the present embodiment, therefore, the contact 51 is brought into point contact, from the beginning of the grinding, with the designed center point (P2) of the end face 31 upon completion of grinding, that is, the designed center point P2 of the end face 31 of the roller workpiece 37 that is supposed to be obtained when grinding of the outer peripheral face 33 on the basis of the designed dimensions is completed. During grinding, the reference member 44 (contact 51) is not moved in any direction.

According to the grinding method, even when the dimensional accuracy of the end face 31 of the roller workpiece 37 to be ground is low, in the outer peripheral face machining step, as the grinding of the outer peripheral face 33 of the roller workpiece 37 proceeds, the roller workpiece 37 is restrained from moving back and forth in the axial direction. As a result, the finish accuracy of the outer peripheral face 33 is increased.

When grinding of the outer peripheral face 33 of the roller workpiece 37 is finished, the grinding wheel 43 is removed from the roller workpiece 37, and then the end face 31 of the roller workpiece 37 is ground (end face machining step). In the end face machining step, the end face 31 of the roller workpiece 37 is ground using the outer peripheral face 33 formed through grinding performed in the outer peripheral face machining step, as the reference. The end face 31 is ground with a grinding wheel (not illustrated) which is different from the grinding wheel 43. For the end face machining step, the conventional method may be adopted.

A second grinding method of grinding the roller workpiece 37 will be described below. The configuration of the grinding apparatus 40 is the same as that described above. The second grinding method is also the same as the first grinding method in that the outer peripheral face 33 of the roller workpiece 37 is ground with the contact 51 of the reference member 44 held in point contact with the center P of the end face 31 of the roller workpiece 37 in the outer peripheral face machining step. In the outer peripheral face machining step in the first grinding method (see FIG. 6), the center P at which the contact 51 is brought into point contact with the end face 31 is the designed center point P2. However, the second grinding method is different from the first grinding method in the center P at which the contact 51 is brought into point contact with the end face 31.

Figure 7:
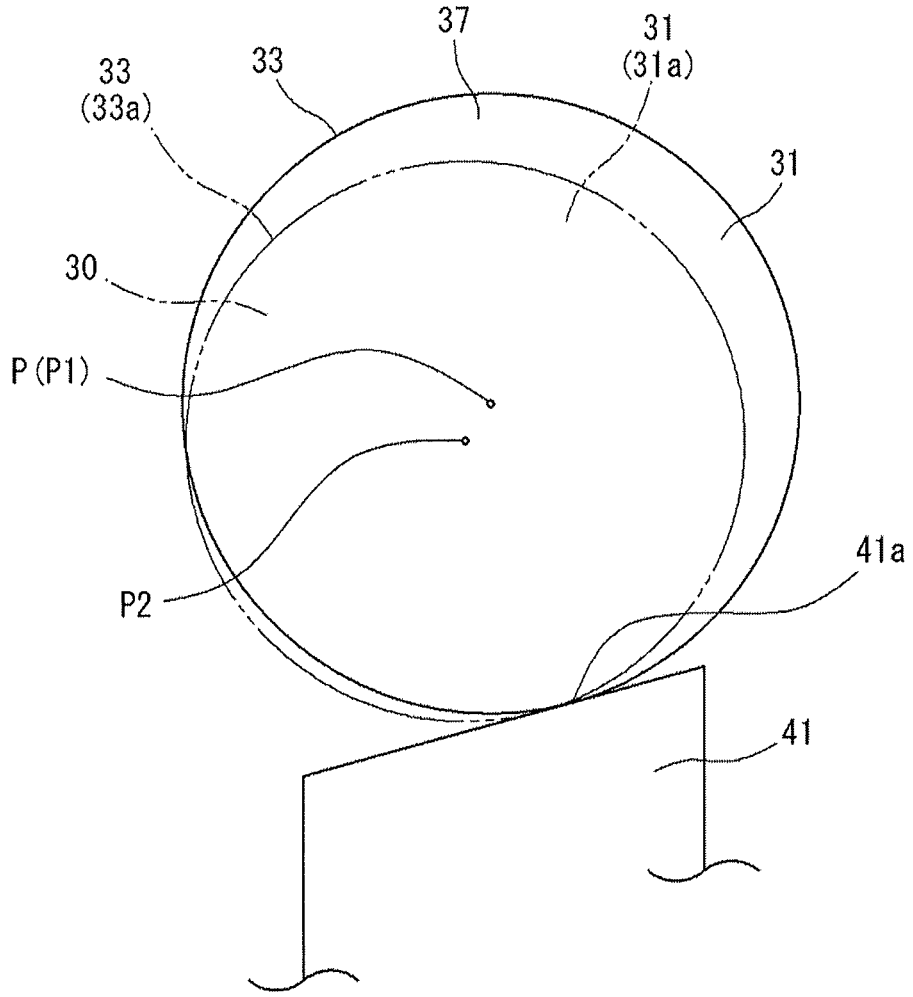
FIG. 7 is a view for explaining a second grinding method of grinding a roller workpiece.

That is, in the outer peripheral face machining step in the second grinding method, the contact 51 of the reference member 44 is brought into point contact with the center P of the end face 31 of the roller workpiece 37 disposed on the blade 41. As illustrated in FIG. 7, the center P at which the contact 51 is brought into point contact with the end face 31 is the center point P1 of the end face 31 of the roller workpiece 37 at the start of grinding of the outer peripheral face 33 of the roller workpiece 37 with the grinding wheel 43. According to the second grinding method, even when the dimensional accuracy of the end face 31 of the roller workpiece 37 to be ground is low, from the beginning of the outer peripheral face machining step, the roller workpiece 37 is restrained from moving back and forth in the axial direction. As a result, it is possible to increase the finish accuracy of the outer peripheral face 33. In FIG. 7, the center point P2 is the center point (designed center point) of the end face 31 of the roller workpiece 37 (the roller 30) upon completion of grinding.

Then, as in the first grinding method, the end face 31 of the roller workpiece 37, of which the outer peripheral face 33 has been ground, is ground (end face machining step).

A third grinding method of grinding the roller workpiece 37 will be described below. The configuration of the grinding apparatus 40 is the same as that described above. The third grinding method is also the same as the first and second grinding methods in that the outer peripheral face 33 of the roller workpiece 37 is ground with the contact 51 of the reference member 44 held in point contact with the center P of the end face 31 of the roller workpiece 37 in the outer peripheral face machining step. In the outer peripheral face machining step in the first grinding method (see FIG. 6), the center P at which the contact 51 is brought into point contact with the end face 31 is the designed center point P2. In the outer peripheral face machining step in the second grinding method (see FIG. 7), the center P at which the contact 51 is brought into point contact with the end face 31 is the center point P1 of the end face 31 of the roller workpiece 37 at the start of grinding of the outer peripheral face 33. However, the third grinding method is different from the first and second grinding methods in the center P at which the contact 51 is brought into point contact with the end face 31.

Figure 8:
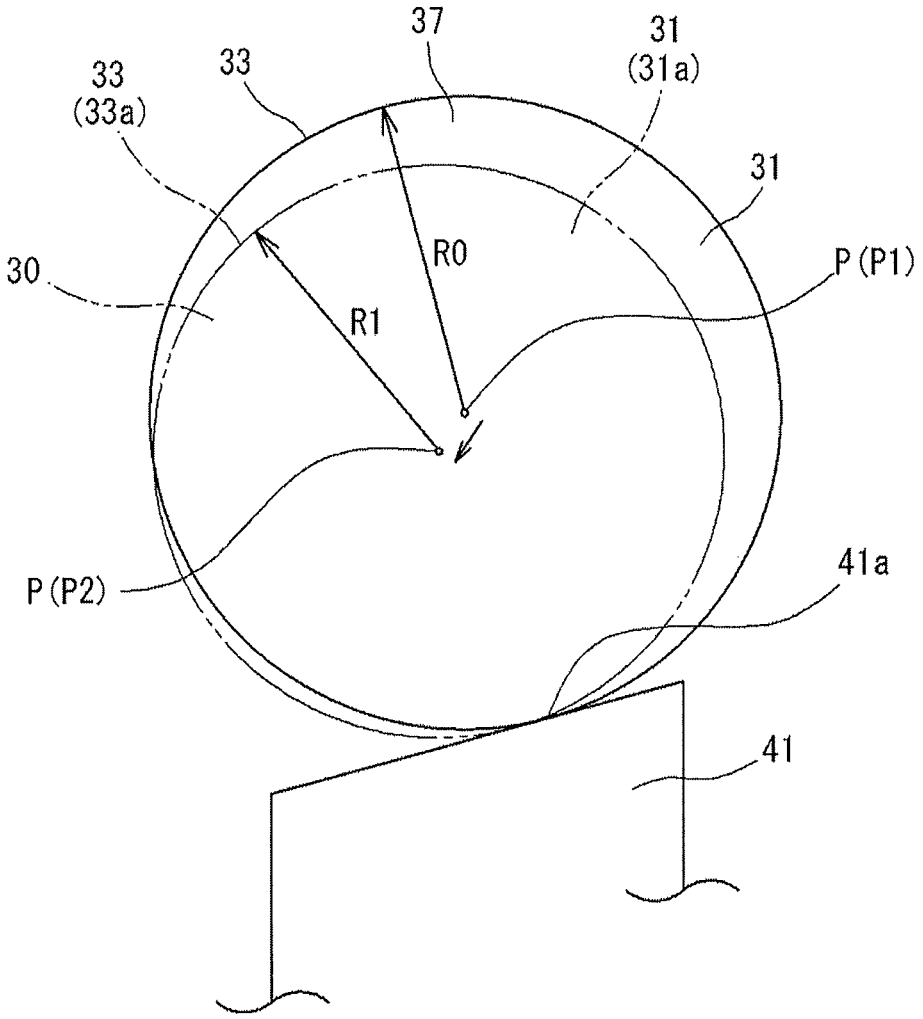
FIG. 8 is a view for explaining a third grinding method of grinding a roller workpiece.
Figure 9A:
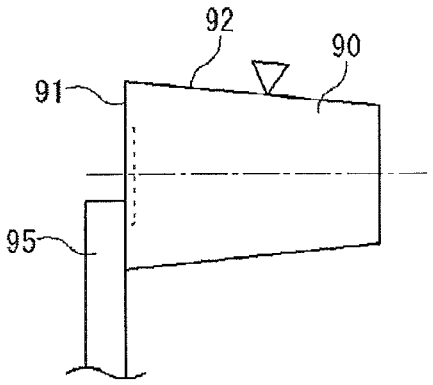
FIG. 9A to FIG. 9E are views for explaining a conventional grinding method.
Figure 9B:
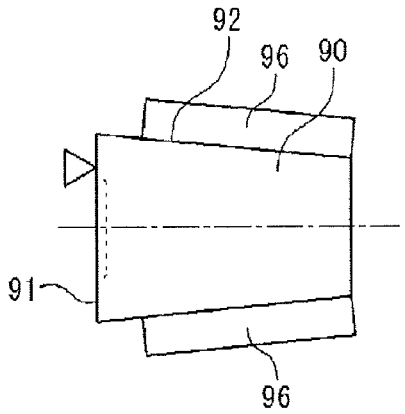
Figure 9C:
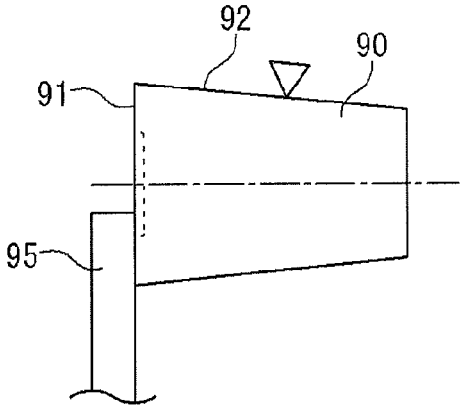
Figure 9D:
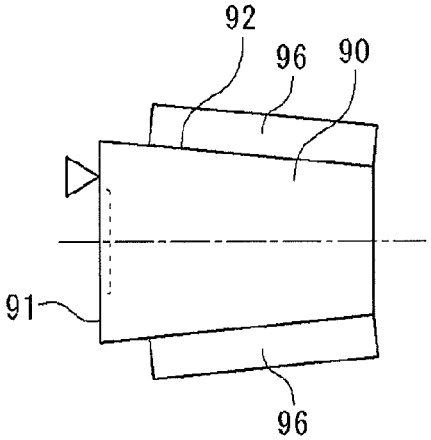
Figure 9E:
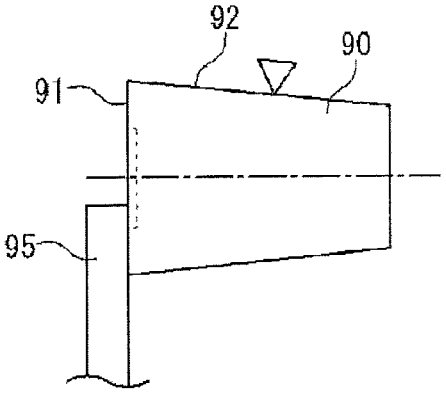

That is, in the outer peripheral face machining step in the third grinding method, the contact 51 of the reference member 44 is brought into point contact with the center P of the end face 31 of the roller workpiece 37 disposed on the blade 41. As illustrated in FIG. 8, the position at which the contact 51 is brought into point contact with the end face 31 is shifted from the first center point P1 of the end face 31 of the roller workpiece 37 at the start of grinding of the outer peripheral face 33 with the grinding wheel 43 to the second center point (designed center point) P2 of the end face 31 of the roller workpiece 37 that is supposed to be obtained when grinding of the outer peripheral face 33 on the basis of the designed dimensions is completed.

The operation of shifting the position at which the contact 51 is brought into point contact with the end face 31 is performed by the actuators 48, 49 (see FIG. 1). After grinding of the outer peripheral face 33 is started, the radius of the circular end face 31 becomes gradually smaller. The actuators 48, 49 move the reference member 44 such that the contact 51 follows the center P of the end face 31 of which the radius is gradually decreasing.

According to the present embodiment, even when the dimensional accuracy of the end face 31 of the roller workpiece 37 to be ground is low, during a period from the beginning of the outer peripheral face machining step until the completion of grinding of the outer peripheral face performed on the basis of the designed dimensions, the roller workpiece 37 is restrained from moving back and forth in the axial direction. As a result, the finish accuracy of the outer peripheral face 33 is increased.

Although any of the first to third grinding methods can be adopted, one of the first to third grinding methods may be selected based on the dimensional accuracy of the roller workpiece 37 before the start of grinding of the outer peripheral face 33. For example, when the dimensional accuracy of the roller workpiece 37 formed through forging and heat treatment performed after the forging is relatively high, only a small machining allowance is required. Thus, a method in which the reference member 44 is fired, such as the first grinding method or the second grinding method may be adopted. Alternatively, one of the first to third grinding methods may be selected based on the diameter of the roller workpiece 37. For example, when the diameter of the roller workpiece 37 is relatively large, a larger machining allowance is required accordingly. Therefore, in this case, it is preferable to adopt a method in which the reference member 44 is moved, such as the third grinding method.

The grinding apparatus according to the invention is not limited to the ones in the above-described embodiments, but may be implemented in other embodiments within the scope of the invention. In the above-described embodiments, the contact 51 has a spherical shape (semispherical shape). However, the contact 51 may have a shape other than a spherical shape (semispherical shape), for example, may have a needle shape. However, comparison of the contact 51 formed in a spherical shape with the contact 51 formed in a needle shape reveals that the contact 51 formed in a spherical shape has a higher rigidity and vibrations are less likely to occur in the spherical contact 51 when the contact 51 is brought into sliding contact with the end face 31. In the above-described embodiments (see FIG. 2 and FIG. 3), no recessed portion is formed in the center portion of the end face 31 of the roller workpiece 37. However, a recessed portion may be formed in the end face 31. In this case, the center P of the end face 31 is located within the recessed portion, the contact 51 is brought into contact with the bottom face of the recessed portion.

In the above-described embodiments, the roller workpiece 37 has a truncated conical shape. That is, the roller workpiece 37 to be formed into a roller of a tapered roller bearing is ground. However, a roller workpiece to be formed into a roller of a cylindrical roller bearing may be ground in any of the methods similar to those in the above-described embodiments. In the case of grinding a cylindrical roller workpiece, a regulating wheel is hourglass-shaped so that the peripheral velocity of the roller workpiece is varied in the axial direction to generate an axial thrust force. Then, the reference member 44 (contact 51) is brought into contact with the end face of the cylindrical roller workpiece on one side in the axial direction so as to receive the thrust force.

According to the invention, even when the dimensional accuracy of the end face of the roller workpiece to be ground is low, the roller workpiece is restrained from moving back and forth in the axial direction because the outer peripheral face of the roller workpiece is ground using a single point at the center of the end face as a reference. In this way, the finish accuracy of the outer peripheral face is increased. As a result, it is possible to increase the dimensional accuracy of the outer peripheral face of a roller without the need for repeatedly grinding the outer peripheral face and grinding the end face as in the related art.

What is claimed is:

1. A grinding method of grinding a roller workpiece to be formed into a roller of a rolling bearing, the grinding method comprising an outer peripheral face machining step of bringing an outer peripheral face of a regulating wheel that is rotating, into contact with an outer peripheral face of the roller workpiece that is supported from below by a support member, to rotate the roller workpiece, and bringing a grinding wheel into contact with the outer peripheral face of the roller workpiece that is rotating to grind the outer peripheral face of the roller workpiece, wherein in the outer peripheral face machining step, the outer peripheral face of the roller workpiece is ground with a reference member held in point contact with a center of an end face of the roller workpiece.

2. The grinding method according to claim 1, wherein the center at which the reference member is brought into point contact with the end face in the outer peripheral face machining step is a designed center point of the end face of the roller workpiece, the designed center point being obtained when grinding of the outer peripheral face based on designed dimensions is completed.

3. The grinding method according to claim 1, wherein the center at which the reference member is brought into point contact with the end face in the outer peripheral face machining step is a center point of the end face of the roller workpiece at the start of grinding of the outer peripheral face with the grinding wheel.

4. The grinding method according to claim 1, wherein a position at which the reference member is brought into point contact with the end face in the outer peripheral face machining step is shifted from a center point of the end face of the roller workpiece at the start of grinding of the outer peripheral face with the grinding wheel to a designed center point of the end face of the roller workpiece, the designed center point being obtained when grinding of the outer peripheral face based on designed dimensions is completed.

5. The grinding method according to claim 1, wherein the roller workpiece has a truncated conical shape.

6. The grinding method according to claim 2, wherein the roller workpiece has a truncated conical shape.

7. The grinding method according to claim 3, wherein the roller workpiece has a truncated conical shape.

8. The grinding method according to claim 4, wherein the roller workpiece has a truncated conical shape.

9. A grinding apparatus for grinding a roller workpiece to be formed into a roller of a rolling bearing, comprising:

a support member that supports the roller workpiece from below;

a regulating wheel that is brought into contact with an outer peripheral face of the roller workpiece and that rotates to rotate the roller workpiece;

a grinding wheel that grinds the outer peripheral face of the roller workpiece that is rotating; and a reference member that restricts an axial movement of the roller workpiece by coming into point contact with a center of an end face of the roller workpiece, and that allows the grinding wheel to grind the roller workpiece using the center as a reference.

10. The grinding apparatus according to claim 9, further comprising an actuator that moves the reference member while the outer peripheral face of the roller workpiece is being ground by the grinding wheel, wherein the actuator moves the reference member to shift a position at which the reference member is brought into point contact with the end face, from a center point of the end face of the roller workpiece at the start of grinding of the outer peripheral face with the grinding wheel to a designed center point of the end face of the roller workpiece, the designed center point being obtained when grinding of the outer peripheral face based on designed dimensions is completed.

* * * * *